US012415645B2

(12) United States Patent
George

(10) Patent No.: US 12,415,645 B2
(45) Date of Patent: Sep. 16, 2025

(54) CAN END FOR BEVERAGE CAN

(71) Applicant: Zuhair H. George, Warrington, PA (US)

(72) Inventor: Zuhair H. George, Warrington, PA (US)

( * ) Notice: Subject to any disclaimer, the term of this patent is extended or adjusted under 35 U.S.C. 154(b) by 0 days.

(21) Appl. No.: 18/391,164

(22) Filed: Dec. 20, 2023

(65) Prior Publication Data

US 2025/0083856 A1 Mar. 13, 2025

Related U.S. Application Data

(60) Provisional application No. 63/582,155, filed on Sep. 12, 2023.

(51) Int. Cl.

| | |
|---|---|
| ***B65D 1/20*** | (2006.01) |
| ***B65D 1/16*** | (2006.01) |
| ***B65D 17/28*** | (2006.01) |

(52) U.S. Cl.

CPC ..... *B65D 1/20* (2013.01); *B65D 1/165* (2013.01); *B65D 17/4012* (2018.01)

(58) Field of Classification Search

CPC . B65D 1/165; B65D 1/20; B65D 7/04; B65D 17/4012; B65D 1/18; B65D 1/16; B65D 1/14; B65D 1/12; B65D 7/42; B65D 7/045; B65D 7/00

USPC ..... 220/270, 272, 359.2, 906

See application file for complete search history.

(56) References Cited

U.S. PATENT DOCUMENTS

| | | | | |
|---|---|---|---|---|
| 3,672,535 | A | 6/1972 | Mcguire | |
| 3,851,787 | A | 12/1974 | Setzer et al. | |
| 3,853,242 | A | 12/1974 | Zundel | |
| 4,480,763 | A * | 11/1984 | Schneider | B65D 17/4012 220/269 |
| 5,494,184 | A * | 2/1996 | Noguchi | B65D 17/4012 220/269 |
| 5,711,448 | A | 1/1998 | Clarke, III | |
| 6,354,458 | B1 * | 3/2002 | Policappelli | B65D 25/465 220/669 |
| 8,950,623 | B2 | 2/2015 | Fleming | |
| 9,145,238 | B2 | 9/2015 | Barreto et al. | |
| 10,850,888 | B2 | 12/2020 | Ramsey et al. | |
| 2004/0031797 | A1 * | 2/2004 | Farnsworth | A47G 19/2227 206/217 |
| 2004/0040963 | A1 * | 3/2004 | Arcati | B65D 1/165 220/269 |
| 2004/0195240 | A1 * | 10/2004 | Brandon | B65D 17/4012 220/269 |
| 2017/0253371 | A1 * | 9/2017 | Ramsey | B21D 51/383 |

* cited by examiner

*Primary Examiner* — Robert Poon

(57) ABSTRACT

A can end comprising an angled disk that descends from the rim of a beverage can, into the cavity of the beverage can at an angle. The can end comprises an angle of preferably 15-degrees to allow for a user to comfortably drink from the beverage can without the angled disk of the can end, touching the nose of the user. The can end includes a tab, a rivet, and a lid wherein a normal force applied to the tab will punch out the lid to reveal an opening wherein liquid may exit through the can end.

12 Claims, 4 Drawing Sheets

CAN END FOR BEVERAGE CAN

FIELD OF THE INVENTION

The present invention relates generally to a beverage container. More specifically, the present invention is a can end for a beverage can, comprising an angled disk to provide a recess.

BACKGROUND OF THE INVENTION

Traditional beverage cans have long been a ubiquitous choice for packaging and distributing a wide array of beverages, ranging from carbonated sodas to fruit juices and alcoholic beverages. These conventional cans, typically cylindrical in shape with flat, horizontal can ends, offer several advantages in terms of storage, stacking, and cost-effectiveness. However, despite their widespread use, they present inherent limitations that have remained largely unaddressed until now.

One of the primary issues with conventional beverage cans is the discomfort experienced by users, particularly when consuming the beverage directly from the can. The typical can end, with its flat surface, lacks consideration for the anatomy of the human face, notably the user's nose. Consequently, users often find themselves struggling to position the can in such a way that allows for unobstructed drinking, leading to awkward and sometimes unpleasant experiences. The discomfort arises from the direct contact of the can end with the user's nose, causing inconvenience and, in some instances, spillage.

Furthermore, the traditional cylindrical shape of beverage cans exacerbates this issue. The cylindrical design, while efficient for storage and distribution, limits the user's ability to tilt the can at an optimal angle for drinking. This often necessitates tilting the head backward, which not only increases the risk of spillage but also places strain on the neck and upper body, leading to discomfort and potential health concerns with extended use.

These issues underscore the need for an innovative solution in the field of beverage can design. The prior art has made attempts to address some of these challenges, such as introducing contoured can ends or adding plastic or rubber attachments to create a buffer between the can and the user's nose. However, these solutions have been far from ideal, often resulting in added production costs, complexity, and consumer dissatisfaction due to the lack of an efficient, universally applicable solution.

An objective of the present invention is to overcome the limitations of the prior art by providing a beverage can end that is ergonomically designed to accommodate the user's nose during the act of drinking. To achieve this objective, the invention incorporates several key components, each contributing to the realization of this innovative solution.

An objective of the present invention is the introduction of an angled surface on the can end. This angled surface is positioned to allow sufficient space for the user's nose, ensuring that it does not come into direct contact with the can end during consumption. The precise angle and dimensions of this surface are engineered to accommodate a wide range of facial structures, thereby enhancing the overall user experience. An additional objective of the present invention is to provide comfort to the user. By eliminating the discomfort caused by the user's nose coming into contact with the can end, it enhances the overall drinking experience, making it more enjoyable and convenient. This feature is particularly valuable in scenarios where users may not have access to alternative drinking vessels, such as when outdoors or during travel.

To ensure practicality and ease of manufacturing, the angled surface is seamlessly integrated into the can end design. This integration not only maintains the structural integrity of the can but also eliminates the need for additional components, minimizing production costs and waste. The present invention is adaptable to various beverage can sizes and types. Whether used for standard 12-ounce soda cans or larger or smaller containers, the angled can end design can be scaled accordingly, ensuring its applicability across the entire spectrum of beverage packaging.

The angled surface design also contributes to spill prevention. By allowing users to drink from the can without tilting it to extreme angles, the risk of spillage is significantly reduced. This feature is of particular importance for carbonated beverages, which are prone to foaming and overflowing when agitated.

In conclusion, the present invention represents a groundbreaking advancement in the field of beverage can design, addressing longstanding issues associated with user comfort and convenience. By introducing an angled surface strategically engineered to accommodate the user's nose, this innovation revolutionizes the way beverages are consumed directly from the can.

SUMMARY OF THE INVENTION

A can end comprising an angled disk that descends from the rim of a beverage can, into the cavity of the beverage can at an angle. The can end includes a tab, a rivet, and a lid wherein a normal force applied to the tab will punch out the lid to reveal an opening wherein liquid may exit through the can end.

DETAIL DESCRIPTIONS OF THE INVENTION

Figure 1:
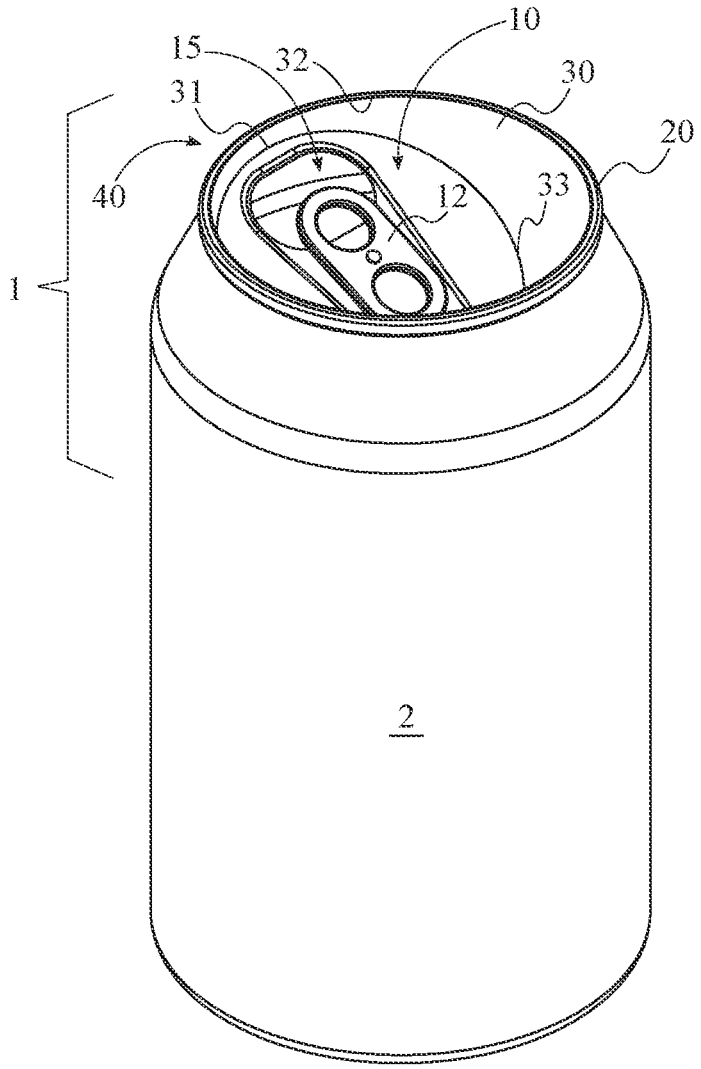
FIG. 1 is a perspective view of the present invention coupled to a beverage can.

All illustrations of the drawings are for the purpose of describing selected versions of the present invention and are not intended to limit the scope of the present invention.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term-differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

The present disclosure includes many aspects and features. Moreover, while many aspects and features relate to, and are described in the context of a can end, embodiments of the present disclosure are not limited to use only in this context.

As disclosed herein, FIGS. 1-4, are representative of the present invention and embodiments thereof. As shown in FIG. 1, the present invention is a can end 1 comprising an angled disk 10, a rim 20, and a wall 30. In the preferred embodiment of the present invention, the can end 1 is coupled to a beverage can 2, as is understood and known within the art. In the preferred embodiment of the present invention, the angled disk 10 is a circular disk descending downwardly from a point 31 of the wall 30. The wall 30 comprises an upper edge 32 wherein said edge is the rim 20, and a lower edge 33 wherein the angled disk 10 is adjacent.

Figure 2:
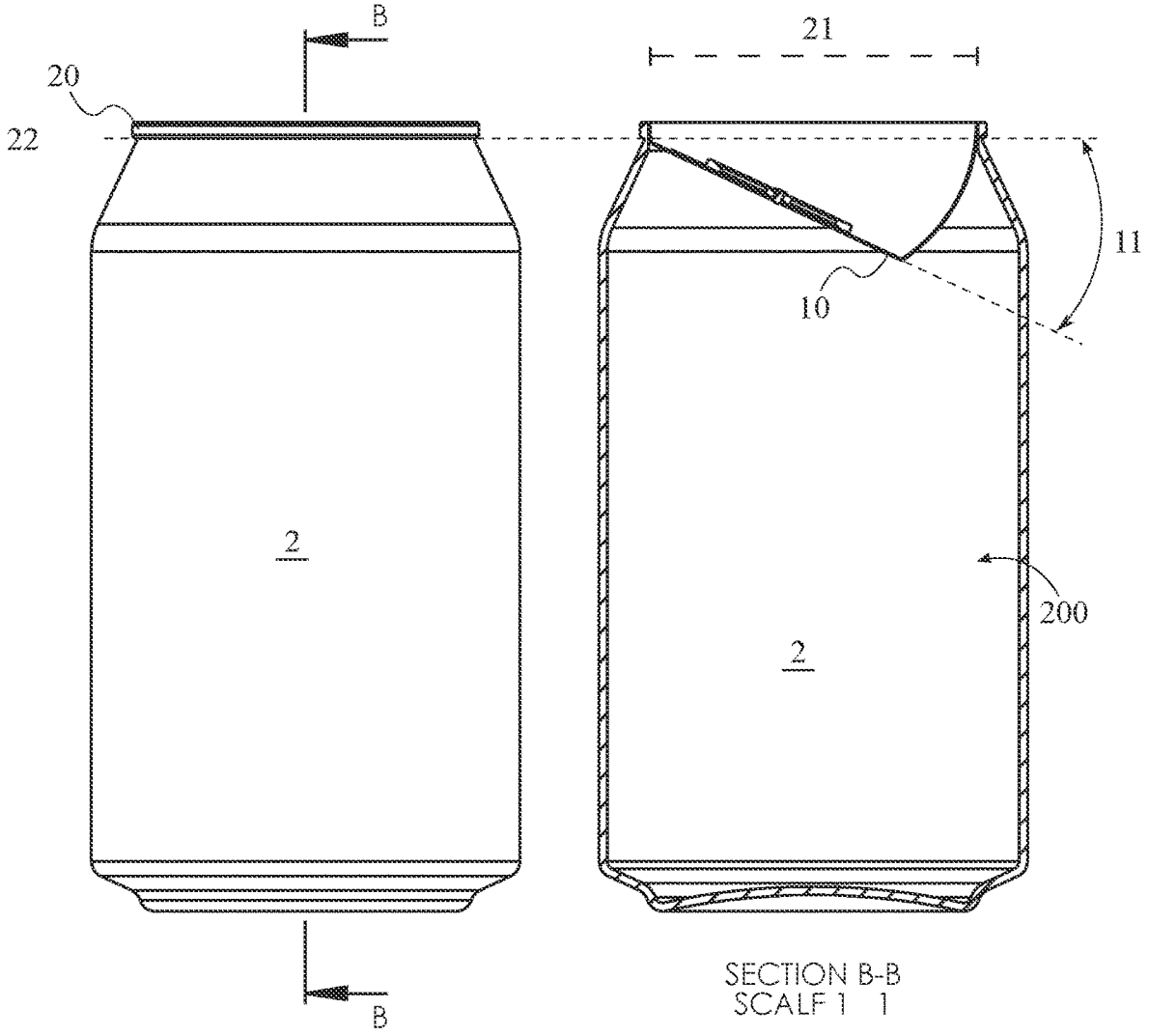
FIG. 2 is a sectional view of the present invention showing the angle and diameter of the can end, wherein the present invention is coupled to a beverage can.

As shown in FIG. 2, the rim 20 of the can end 1, comprising a diameter 21, lies on an imaginary horizontal plane 22, whereby the angled disk 10 comprises an angle 11 whereby said angle 11 is relative to the horizontal plane 22. In the context of the present invention, the angle 11 is provided to allow for a user to comfortably drink from the beverage can without the angled disk 10 of the can end 1, touching the nose of the user. In the context of the present invention, the angle 11 of the angled disk 10 is less than 90 degrees. In the preferred embodiments of the present invention, the angle 11 is a 10-degree angle, downward, relative to the horizontal plane 22 shared by the rim 20. In alternative embodiments, the present invention comprises an angle 11 of 15-degrees downward from the horizontal plane 22. In some embodiments of the present invention, the angle 11 of the angled disk 10 is 45-degrees. Further, as shown in FIG. 2, in the preferred embodiment of the present invention, the rim 20 of the present invention is coupled to a beverage can 2 comprising a cavity 200 whereby the angled disk 10 descends into the cavity 200 of the beverage can 2. In the preferred embodiment of the present invention, the beverage can 2, containing a liquid, is able to be poured through an opening 15 of the angled disk 10.

Figure 3:
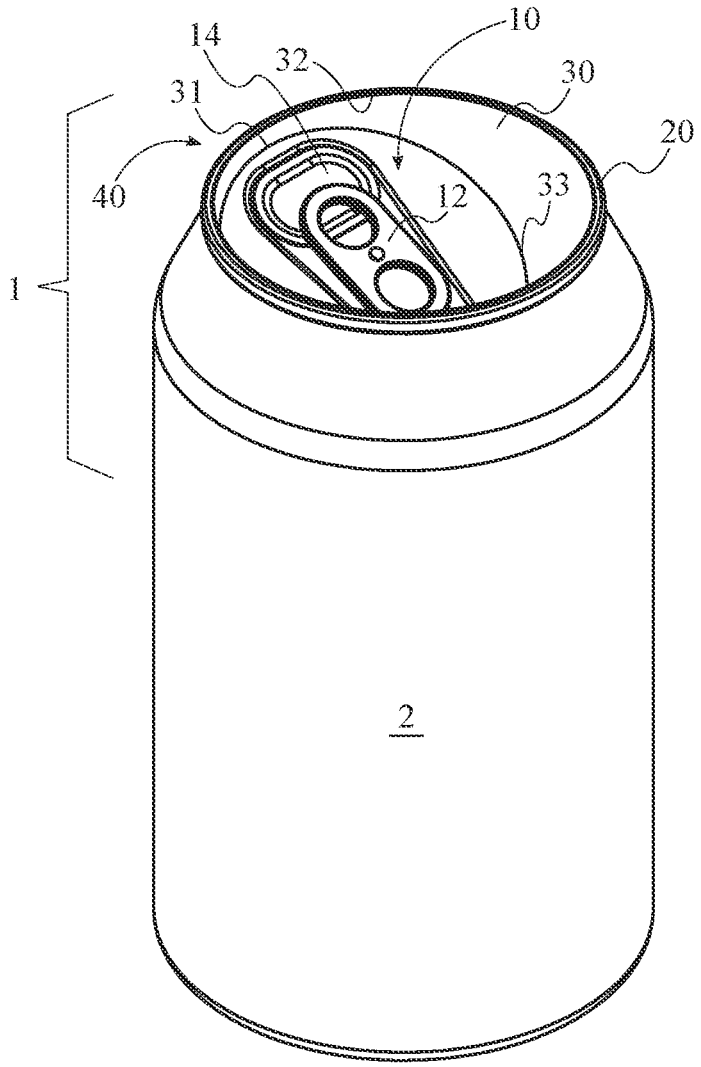
FIG. 3 is an alternate perspective view of the present invention coupled to a beverage can.
Figure 4:
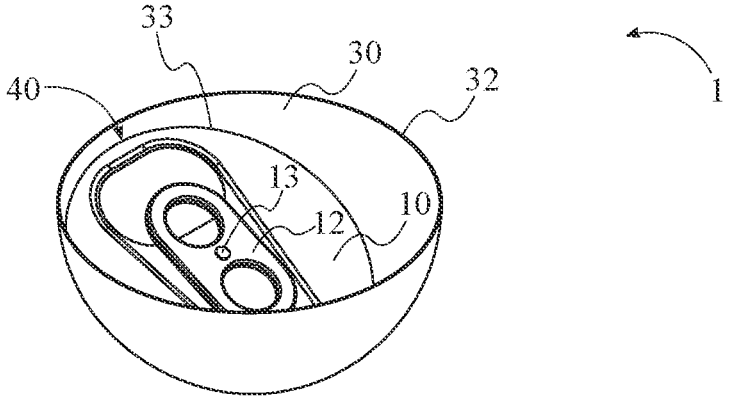
FIG. 4 is a perspective view of the present invention, showing the opening.

Within the preferred embodiment, as shown in FIG. 3, the angled disk 10 of the present invention further comprises a tab 12 and a lid 14. In the preferred embodiment, the tab 12 is connected to an upwardly facing surface of the angled disk 10 by a rivet 13, as shown in FIG. 4. Furthermore, as shown in FIG. 3, the tab 12 is adjacent to the lid 14, whereby the lid 14 may be punched open when an normal force is exerted to the tab 12, as is understood to those in the art. In the preferred embodiment of the present invention, the lid 14 is punched to reveal the opening 15 wherein the opening 15 is proximate to a base 40 of the can end 1, wherein the base 40 is the portion of the can end closest to the rim 20 and thus, having the highest elevation of the angled disk 10, as shown in FIG. 4. The opening 15 is a through hole through the angled disk 10 of the can end 1.

The present invention is manufactured and attached to beverage cans 2 using methods known to those in the art. Although the invention has been explained in relation to its preferred embodiment, it is to be understood that many other possible modifications and variations can be made without departing from the spirit and scope of the invention.

What is claimed is:

1. A can end for a beverage can comprising:
an angled disk;
a rim;
a wall;
a tab;
a beverage can; and
an opening
wherein:
the angled disk is a circular disk;
the wall comprising an upper edge and a lower edge wherein the upper edge of the wall is adjacent to the rim, and the lower edge of the wall is adjacent to the angled disk;
the wall further traversing the circumference of the angled disk, extending upward, thus interposed between the rim and the angled disk;
the angled disk is positioned below the rim such that the angled disk extends downwardly at a constant angle from a point adjacent to the rim to the lower edge of the wall;
the beverage can comprises a cavity;
the angle disk and the wall descending into the cavity of the beverage can;
the angle being greater than zero-degrees and less than 90-degrees;
the opening is a hole through the angled disk;
the opening is vertically offset from the tab such that the opening is proximate a portion of the angled disk comprising a highest elevation; and
the wall comprises a varying height about the circumference of the angled disk such that the height of the wall proximate the opening is less than the height of the wall proximate a lowest point of the wall.

2. The can end for a beverage can as claimed in claim 1, wherein the angle is ten degrees downward, relative to a horizontal plane possessed by the rim.

3. The can end for a beverage can as claimed in claim 1, wherein the angle is 15 degrees downward, relative to the horizontal plane of the rim.

4. The can end for a beverage can as claimed in claim 1, wherein the angle is 45 degrees downward, relative to the horizontal plane of the rim.

5. The can end for a beverage can as claimed in claim 1 wherein the angled disk further comprises a rivet, wherein said rivet couples the tab to the angled disk.

6. The can end for a beverage can as claimed in claim 5 wherein the angled disk further comprises a lid, wherein a normal force applied to the tab displaces the lid.

7. The can end for a beverage can as claimed in claim 6 wherein the displacement of the lid reveals the opening.

8. The can end for a beverage can as claimed in claim 1 wherein the rim comprises a diameter.

9. A can end for a beverage can comprising:
an angled disk;
a rim;
a wall;
a tab;
a beverage can; and
an opening
wherein:
the angled disk is a circular disk;
the beverage can comprises a cavity;
the wall comprising an upper edge and a lower edge wherein the upper edge of the wall is adjacent to the rim, and the lower edge of the wall is adjacent to the angled disk;
the wall further traversing the circumference of the angled disk, extending upward, thus interposed between the rim and the angled disk;
the angled disk is positioned below the rim such that the angled disk extends downwardly at a constant angle into the cavity of the beverage can;
the opening is vertically offset from the tab such that the opening is proximate a portion of the angled disk comprising a highest elevation; and
the wall comprises a varying height about the circumference of the angled disk such that the height of the wall proximate the opening is less than the height of the wall proximate a lowest point of the wall; and
the constant angle being ten degrees.

10. The can end for a beverage can as claimed in claim 9 wherein the angled disk further comprises a rivet, wherein said rivet couples the tab to the angled disk.

11. The can end for a beverage can as claimed in claim 10 wherein the angled disk further comprises a lid, wherein a normal force applied to the tab displaces the lid.

12. The can end for a beverage can as claimed in claim 11 wherein the displacement of the lid reveals the opening wherein said opening is a through hole through the angled disk.

* * * * *